US005209695A

United States Patent [19]

Rothschild

[11] Patent Number: 5,209,695

[45] Date of Patent: May 11, 1993

[54] SOUND CONTROLLABLE APPARATUS PARTICULARLY USEFUL IN CONTROLLING TOYS AND ROBOTS

[76] Inventor: Omri Rothschild, 4 Abraham Lev Street, 64 283 Tel Aviv, Israel

[21] Appl. No.: 699,015

[22] Filed: May 13, 1991

[51] Int. Cl.[5] ..... A63H 30/00; A63H 30/04

[52] U.S. Cl. ..... 446/175; 367/197; 395/82; 395/93; 901/1; 446/456

[58] Field of Search ..... 446/175, 456; 340/825.69; 367/197, 198; 358/194.1; 381/110, 56; 901/1; 395/80, 88, 92, 93, 99, 82

[56] References Cited

U.S. PATENT DOCUMENTS

| | | | |
|---|---|---|---|
| 2,832,426 | 4/1958 | Seargeant | 446/433 X |
| 2,974,441 | 3/1961 | Denner | 446/175 |
| 3,836,959 | 9/1974 | Pao et al. | 367/198 X |
| 3,892,920 | 7/1975 | Kolm | 367/197 |
| 3,944,982 | 3/1976 | Mogi et al. | 367/197 |
| 4,168,468 | 9/1979 | Mabuchi et al. | 340/825.69 X |
| 4,507,653 | 3/1985 | Bayer | 367/198 X |
| 4,641,292 | 2/1987 | Tunnell et al. | 367/198 |

*Primary Examiner*—Mickey Yu
*Attorney, Agent, or Firm*—Benjamin J. Barish

[57] ABSTRACT

An apparatus for controling a device by sound commands includes a microphone for receiving the sound command, and a processor for analysing the received sound commands and for determining the number of space-separated words or other interrupted sounds in a received sound command. The processor measures the time of interruption between the received sounds and determines that the end of a word has occurred if the interruption is above a first predetermined time period, and that the end of a command has occurred if the interruption is above a second, higher, predetermined time period. A control system controls the device in accordance with the number of space-separated words in the received sound command.

12 Claims, 4 Drawing Sheets

FIG. 2
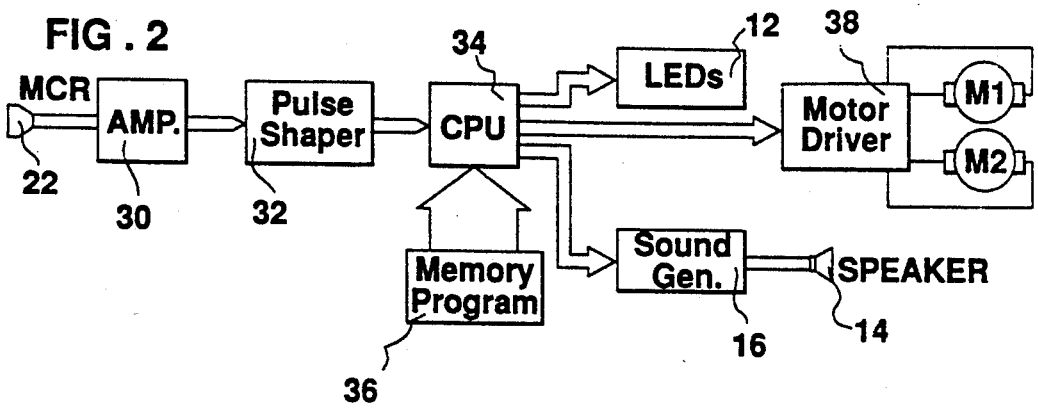
FIG. 3
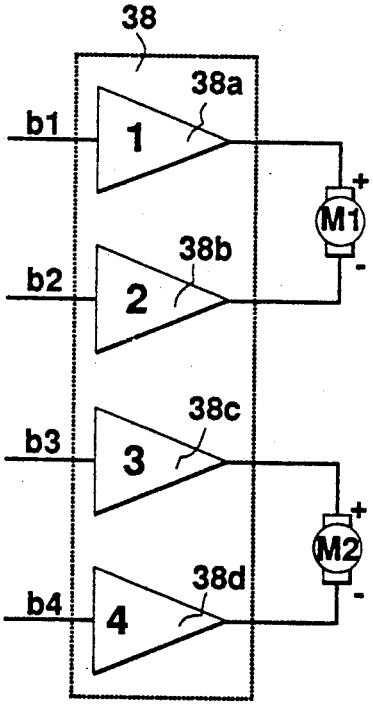
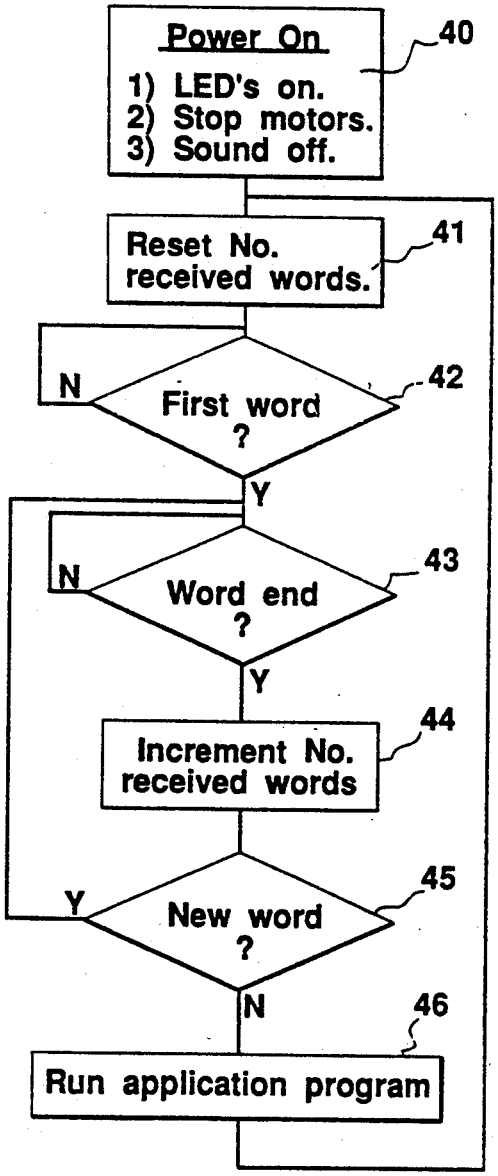
FIG. 4

SOUND CONTROLLABLE APPARATUS PARTICULARLY USEFUL IN CONTROLLING TOYS AND ROBOTS

FIELD AND BACKGROUND OF THE INVENTION

The present invention relates to sound-controllable apparatus for controlling a device by sound commands. The invention is particularly useful for controlling toy robots, and is therefore described below with respect to this application for purposes of example.

Many types of toy robots are known which include drives for driving the robot over horizontal surfaces, and other devices for performing other function, such as blinking lights, sound generators, and the like. Such robots generally receive their command signals by means of a wire link between the transmitter and the robot. The need for such a wire link not only limits the mobility of the toy robot, but also detracts from the entertainment value of manipulating such a robot. It has been proposed to control the robot by a wireless link, such as by the use of radio frequency commands, infrared commands or sound commands, but such systems substantially increase the overall cost of the toy robot.

OBJECTS AND SUMMARY OF THE INVENTION

An object of the present invention is to provide sound-controllable apparatus of very simple and inexpensive construction which may be used for controlling various types of devices by sound commands. Another object of the invention is to provide a toy robot of simple and inexpensive construction controllable by sound commands.

According to the present invention, there is provided apparatus for controlling a device by sound commands, comprising: a microphone for receiving the sound commands; a processor for analyzing the received sound commands and for determining the number of space-separated words or other interrupted sounds, such as beeps, hand- claps, whistles, etc., in a received sound command; and a control system for controlling the device in accordance with the number of space-separated words (or other sounds) in the received sound command.

According to further features in the preferred embodiment of the invention described below, the processor includes means for measuring the time of interruption between the received sounds and determines that the end of a word has occurred if the interruption is above a first predetermined time period, and that the end of a command has occurred if the interruption is above a second, larger, predetermined time period. As one example, the first predetermined time period is a fraction of one second, and the second predetermined time period is between 1–3 seconds.

According to further features in the preferred embodiment of the invention described below, the device is a toy robot capable of performing a number of different operations as controlled by the control system.

It will be seen that sound-controllable apparatus in general, and toy robots in particular, may be constructed in accordance with one or more of the foregoing features of the invention to provide a very simple and inexpensive control.

Further features and advantages of the invention will be apparent from the description below.

BRIEF DESCRIPTION OF THE DRAWINGS

The invention is herein described, by way of example only, with reference to the accompanying drawings, wherein:

FIG. 2 is a block diagram of the electrical circuit in the toy robot of FIG. 1;

FIG. 3 is a block diagram more particularly illustrating the motor control system in the toy robot of FIG. 1;

FIG. 4 is a flow chart illustrating one example of a main program for operating the toy robot of FIG. 1.

DESCRIPTION OF PREFERRED EMBODIMENTS

Figure 1:
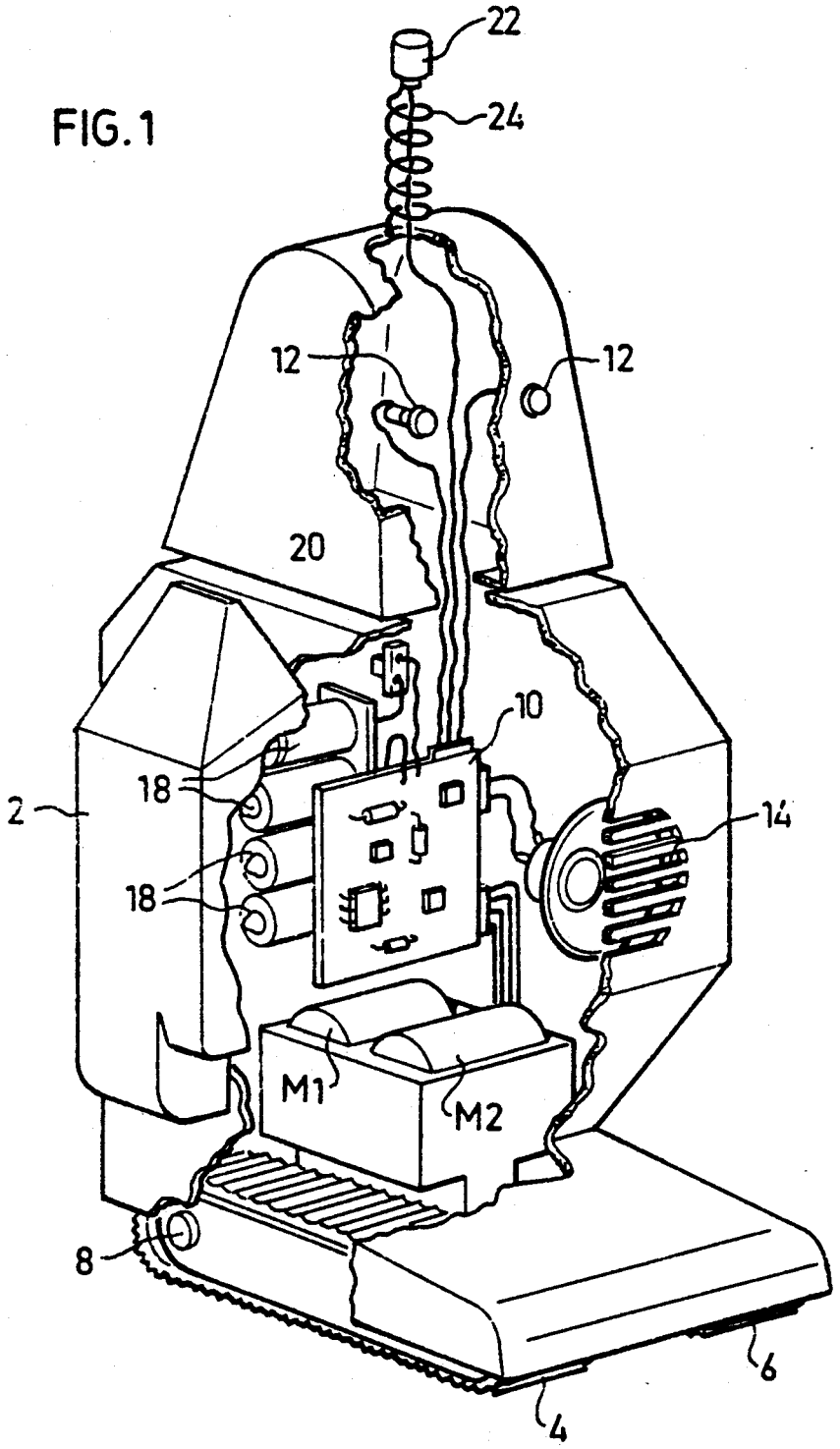
FIG. 1 is a pictorial illustration, partly broken away to show internal structure, illustrating one form of toy robot constructed in accordance with the present invention.

The toy robot illustrated in FIG. 1 includes a body, generally designated 2, and a drive comprising two caterpillar tracks 4, 6 for propelling the toy robot over a horizontal surface. Each of the caterpillar tracks 4, 6 is driven by a motor $M_1$, $M_2$ (FIG. 3) about a common axis, shown at 8 in FIG. 1. The two motors $M_1$, $M_2$ are individually controllable to rotate either forwardly or revefsely, and thereby the two motors are capable of driving the tracks 4, 6 such as to propel the toy robot in any direction over a horizontal surface, such as the floor.

The two drive motors $M_1$, $M_2$ are controlled by electrical circuitry carried by a printed circuit board 10 within the toy robot. The electrical circuitry on board 10 controls, not only the two motors $M_1$, $M_2$, but also two LED's (light emitting diodes) 12, serving as the eyes of the toy robot, and a speaker 14 driven by a sound generator 16 (FIG. 2) also carried by the toy robot. Thus, the eyes 12 can be controlled so as to be energized when the electrical circuit for the toy robot is turned on, and can also be controlled to blink during some operations of the toy robot; and the sound generator 16 and speaker 14 can be controlled to produce various sounds, such as speech or action sounds, during various operations of the toy robot.

The two drive motors $M_1$, $M_2$, as well as the other electrical devices within the toy robot 2, are supplied by batteries 18 carried within the robot body 2 for convenient replacement. The electrical circuit is controlled by a manual on/off switch 20 conveniently accessible, e.g., from the back face of the toy robot.

The toy robot further includes a microphone 22 for receiving sound commands. Microphone 22 may be carried at the end of a spring 24.

The electrical circuit included within the toy robot 2 is more particularly illustrated in FIG. 2. Thus, the microphone 22 is connected to an amplifier 30 which amplifies the electrical signals outputted by the microphone and applies them, via pulse shaper 32, to a CPU (central processor unit) 34 of a microprocessor controlled by a program 36. The output of CPU 34 is applied to a motor control or driver circuit 38 to control the operation of the two motors $M_1$, $M_2$ driving the caterpillar tracks 4, 6 for propelling the toy robot. The output from CPU 34 also controls the LED's 12, and the sound generator 16 and its microphone 14.

FIG. 3 illustrates the motor driver circuit 38 which includes four inputs $B_1$–$B_4$ from the CPU 34. The two motors $M_1$, $M_2$ are reversible motors, and therefore they may be controlled to propel the toy robot in any direction by the proper application of a high (H) or low (L) signal to the four inputs $B_1$–$B_4$. The following table illustrates one manner of controlling the two motors to control the starting, stopping and direction of movement of the toy robot:

| $B_4$ | $B_3$ | $B_2$ | $B_1$ | Application | Description |
|---|---|---|---|---|---|
| L | L | L | L | — | Stopped |
| L | H | L | H | 1 | Forward |
| H | L | H | L | 2 | Backward |
| H | L | L | L | 3 | Turn to left |
| L | L | H | L | 4 | Turn to right |

The microprocessor including the CPU 34 analyzes the sound commands received by the microphone 22 and determines the number of space-separated words (or other interrupted sounds) in a received command. After it has determined the number of such space-separated words in a received command, it outputs logic signals to the motor drive circuit 38 to control the motors $M_1$ and $M_2$, and also to control the LED's 12 and sound generator 16, according to the number of words determined to be present in the received sound command. Following is an example of one mode of operation of the toy robot according to the number of words determined to be present in the received command:

If the received command consists of one word, all activities of the robot are terminated if at the time of receipt of such command it was performing some other activity; if not, the toy robot is commanded to move forwardly. If the received command consists of two words, the robot moves backwardly; if the received command consists of three words, the robot turns to the left; if the received command consists of four words, the robot turns to the right; and if the received command consists of five words, the sound generator 16 produces a sound via the speaker 14, and also the LED's 12 are energized to cause them to blink for a limited time.

FIG. 4 is a flow chart illustrating the main program of operation of the toy robot. Thus, when the power is turned on, either by the manual On/Off switch 20, or by the switch 29 automatically actuated when the microphone 22 is moved out of its housing 28 for use in receiving voice commands, the two LED's 12 are energized, thereby indicating that the toy robot is operational; the two motors $M_1$, $M_2$ are deenergized; and the sound generator 16 is deenergized, as indicate by block 40 in FIG. 4. The CPU 34 (more particularly a counter within it) is reset to zero (block 41), and the apparatus is now in operable condition waiting for its microphone 22 to receive a sound, which is translated as the beginning of the first word (block 42).

When an interruption in the sound is detected, the microprocessor determines whether this interruption exceeds a predetermined time interval (block 43), and if so, it determines the interruption to constitute the end of the first word. The microprocessor then increments (e.g., its counter) by one increment (block 44), and waits for the receipt of the next sound (block 45). If the next sound is received within a second predetermined time interval, it determines that that is the next word of the same command and then returns to block 43; on the other hand, if the next sound exceeds the predetermined time interval, it determines that the respective sound command has terminated, and then it runs the application program according to the number of received words and the present status of the robot (block 46).

Figure 5:
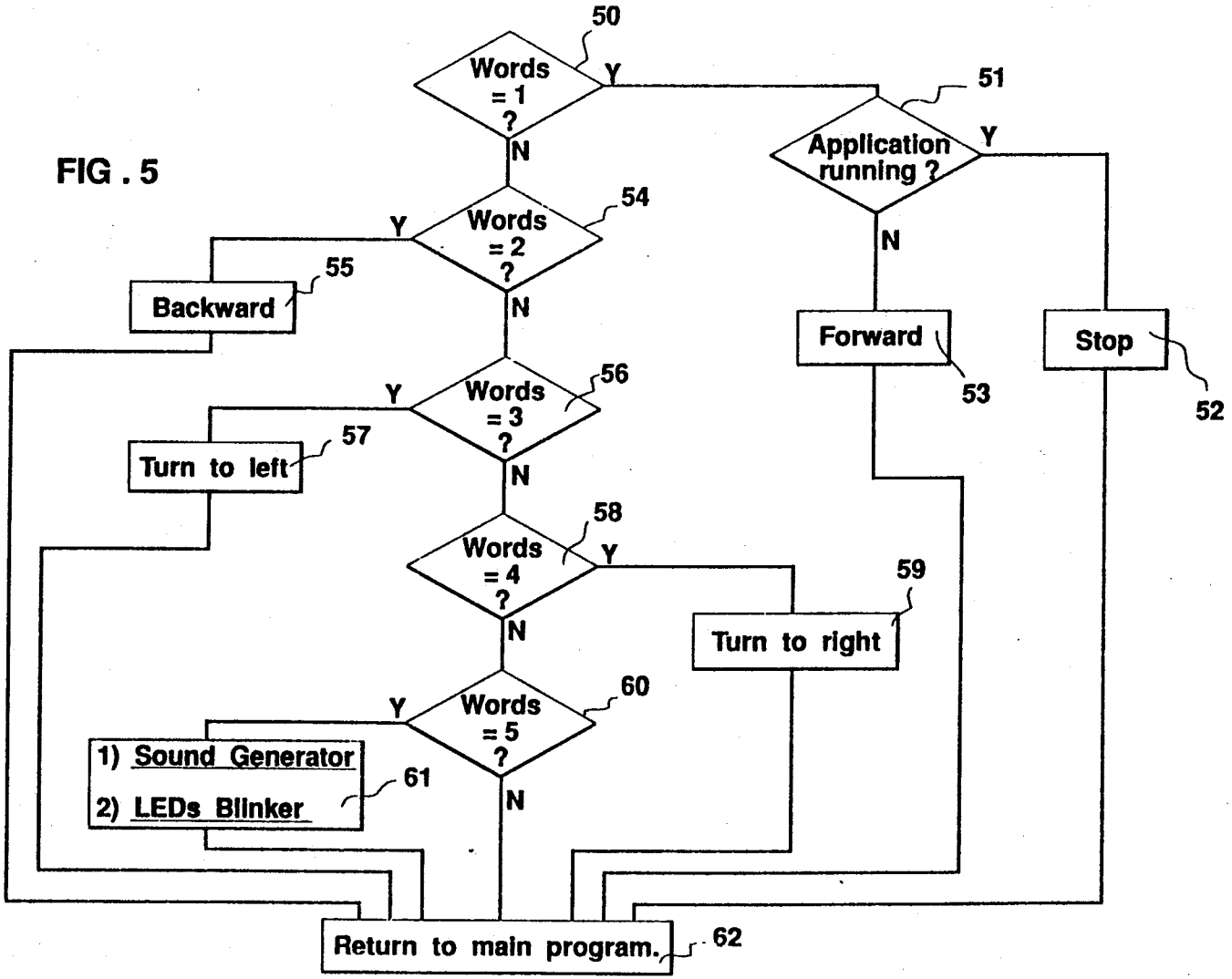
FIG. 5 is a flow chart illustrating an example of an application program for operating the toy robot of FIG. 1.

The flow chart of FIG. 5 illustrates the example of the operation described above:

Thus, if it was determined that the command consists of one word (block 50), a check is first made as to whether the robot is then performing any other function (block 51). If yes, the command causes the robot to stop all activities; but if not, a positive voltage is applied to both motors $M_1$, $M_2$, causing the robot to move forwardly.

If the voice command was found to consist of two words (block 54), a negative voltage is applied to both motors $M_1$, $M_2$, causing the toy to move backwardly block 55).

If the voice command was found to consist of three words (block 56), no voltage is applied to the right motor $M_1$, and a negative voltage is applied to the left motor $M_2$, causing the robot to turn to the left (block 57).

If the voice command was found to consist of four words (block 58), a negative voltage is applied to the right motor $M_1$, and no voltage is applied to the left motor $M_2$, thereby causing the robot to turn to the right (block 59).

If the voice command was found to consist of five words (block 60), the sound generator 16 is actuated to output a predetermined sound from the speaker 14, and also the LED's are energized in a blinker mode, both operations being for a limited period of time (block 61).

After each of the foregoing operations, the application's program returns to the main program (block 62).

As one example, the time interval measured in block 43, for determining whether an interruption in the sound indicates the start of a new word, should be less than one second, preferably about one-third second; and the time interval measured in block 45, for determining whether the interruption in the sound indicates the end of the respective command, may be from one-three seconds, preferably about two seconds.

FIGS. 1–5 of the drawings illustrate one preferred embodiment of the invention, but it will be appreciated that this is set forth purely of purposes of example, and that many variations and other applications of the invention may be made. For example, the system could have a capacity for executing more than five different commands. In addition, the invention could be embodied in other types of toys performing other functions, such as in dolls capable of crying, laughing, talking and answering, in addition to performing various movements, such as walking, crawling, moving hands, legs, head, etc. The invention could also be used to control other types of devices, such as controlling various operations in television sets, e.g., starting, channel selection, movement of objects on the screen, and the like.

Figure 6:
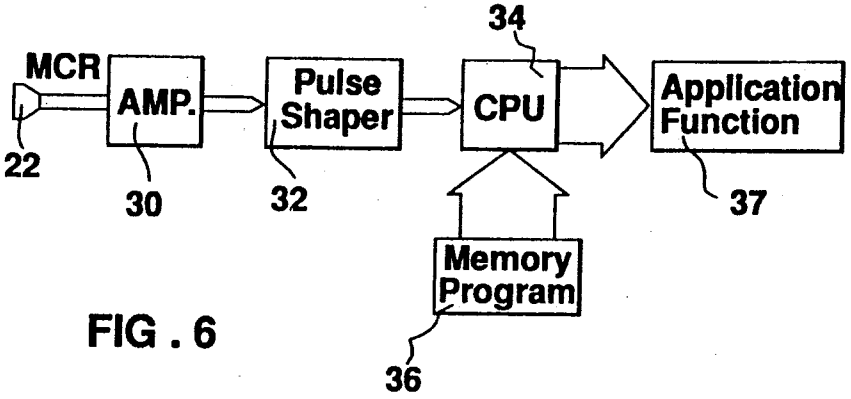
FIG. 6 is a block diagram illustrating the electrical circuit corresponding to that of FIG. 2 but for general applications.

FIG. 6 is a block diagram, corresponding to that of FIG. 2, but for general application. Thus, the block diagram illustrated in FIG. 6 includes the same elements as in FIG. 2. These elements are correspondingly numbered to facilitate understanding, except that the output of the CPU 34 is applied to an Application Function block 37, which controls the function or operation of the controlled device according to the particular application. As indicated above, such applications could include, in addition to robot controls, also television set controls, and the like.

Figure 7:
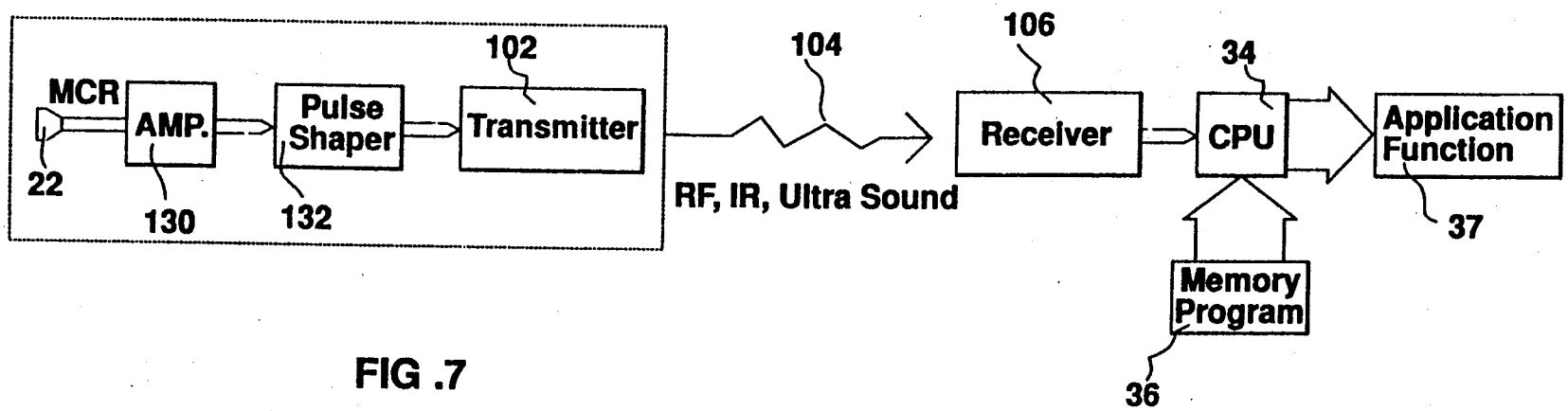
FIG. 7 is a block diagram corresponding to that of FIG. 6 wherein the microphone is included in a separate hand-held unit controlling the controlled device via a wireless link.

The block diagram of FIG. 7 illustrates a further application of the invention. Thus, instead of having the controlled device carry the microphone, as described above with respect to the toy robot application of FIGS. 1-5, the microphone could be included in a separate hand-held unit, which unit would also include means for converting the sounds to signals and for transmitting the signals via a wireless link to the controlled device.

The latter variation is illustrated in the block diagram of FIG. 7, wherein the separate hand-held unit is generally designated 100. It includes the microphone 122, amplifier 130, and pulse shaper 132 corresponding to microphone 22, amplifier 30 and pulse shaper 32 in the FIGS. 1-5 embodiment. The separate hand-held unit 100 further includes a transmitter 102 which transmits the signals via a wireless link 104 to a receiver 106 carried by the controlled device, (e.g. a toy robot) as illustrated in FIG. 1. The controlled device further includes the CPU 134, under the control of a memory program 136 for performing certain control functions, as indicated by block 137, according to the particular application of the system. The wireless link 104, and thereby the transmitter 102 and receiver 106, may be infrared, radio frequency, or even sonic.

As indicated earlier, in all the described embodiments the sounds need not be speech or words, but could be other forms of sounds, e.g. beeps from a beeper, clapping with the hands, whistling, tapping with an implement, etc. In addition, the sounds may be limited to a particular frequency band to prevent disturbance by spurious or other sounds. Many other variations, modifications and applications of the invention will be apparent.

What is claimed is:

1. Apparatus for controlling a device according to different sound commands, comprising:

a microphone for receiving sounds;

a processor including means for measuring the time of interruption between the received sounds, and means for determining that the end of a sound has occurred if the interruption is within a first predetermined time period, and that the end of a command has occurred if the interruption is within a second, larger, predetermined time period; said first predetermined time period being a fraction of one second, and said second predetermined time period being between 1-3 seconds;

and a control system for controlling the device in accordance with the number of interrupted sounds in the received sound command.

2. A system including, in combination, the apparatus according to claim 1, and a toy robot capable of performing a number of different operations as controlled by said control system.

3. The system according to claim 2, wherein said toy robot includes a drive controlled by said control system for driving the robot over a surface.

4. The system according to claim 3, wherein said drive includes two electrical motors driving at least two rotary propulsion members about a common axis, said electrical motors being individually controllable to rotate forwardly or reversely, and thereby to drive the toy robot in any direction over said surface.

5. The system according to claim 4, wherein said control system includes motor control means which, upon determining that the received sound command is constituted of a single sound, terminates the operation of both motors if either one was in operation immediately before the command was received, and operated both motors in the forward direction to propel the toy robot forwardly if neither motor was in operation immediately before the command was received.

6. The system according to claim 2, wherein said toy robot carries the microphone.

7. The system according to claim 1, wherein said microphone is included in a separate hand-held unit, which unit includes means for converting the sounds to signals and for transmitting said signals via a wireless link to the controlled device.

8. A toy robot comprising:

a drive for driving the robot over a surface;

a microphone carried by the robot for receiving different sound commands;

a processor for analyzing the received sound commands and for determining the number of interrupted sounds in a received sound command;

said processor including means for measuring the time of interruption between the received sounds and means for determining that the end of a sound has occurred if the interruption is above a first predetermined time period, and that the end of a command has occurred if the interruption is above a second, larger, predetermined time period;

and control system for controlling said drive in accordance with the number of interrupted sounds in the received sound command.

9. The apparatus according to claim 8, wherein said drive includes two electrical motors driving at least two rotary propulsion members about a common axis, said electrical motors being individually controllable to rotate forwardly or reversely, and thereby to drive the toy robot in any direction over said surface.

10. The robot according to claim 9, wherein said control system includes means which, upon determining that the received sound command is constituted of a single sound, terminates the operation of both motors if either one was in operation immediately before the command was received and operates both motors in the forward direction to propel the toy robot forwardly if neither motor was in operation immediately before the command was received.

11. The robot according to claim 8, wherein said robot carries the microphone.

12. The robot according to claim 8, wherein said microphone is included in a separate hand-held unit, which unit includes means for converting the sounds to signals and for transmitting them via a wireless link to the robot.

* * * * *